United States Patent [19]

Stephanoff, deceased et al.

[11] Patent Number: 4,526,324

[45] Date of Patent: Jul. 2, 1985

[54] JET-TYPE GRINDING MILL

[76] Inventors: Nicholas N. Stephanoff, deceased, late of Haverford, Pa.; Raymond S. Page, III, executor, 1100 One Franklin Plaza, Philadelphia, Pa. 19102

[21] Appl. No.: 586,115

[22] Filed: Mar. 5, 1984

[51] Int. Cl.[3] ..... B02C 19/06

[52] U.S. Cl. ..... 241/5; 241/39

[58] Field of Search ..... 241/5, 39, 40, 24, 152 R

[56] References Cited

U.S. PATENT DOCUMENTS 2,385,508 9/1945 Hammond ..... 241/39 X 4,198,004 4/1980 Albus et al. ..... 241/39

FOREIGN PATENT DOCUMENTS 482407 4/1952 Canada ..... 241/39

*Primary Examiner*—Mark Rosenbaum

*Attorney, Agent, or Firm*—Arthur A. Jacobs

[57] ABSTRACT

A jet-type grinding mill wherein particles are entrained in a circulating gaseous vortex and caused to pulverize each other during their passage through the mill, the mill having a classifier or separator section wherein there are a pair of coaxial tubular nozzles, one within and radially spaced from the other, the two nozzles forming an auxiliary cyclone-type separator means whereby the lightest of the ground particles pass through the inner nozzle as final product while the heavier ground particles are recycled back for further processing.

10 Claims, 6 Drawing Figures

JET-TYPE GRINDING MILL

This invention relates to jet or "fluid energy" type grinding mills utilizing whirling gaseous fluids as the grinding or pulverizing medium, and it particularly relates to mills of this type which are particularly adapted to grind particles of relatively large size such as coal and the like.

The type of mill utilized in the present invention is basically similar to that disclosed in U.S. Pat. No. 4,131,239, dated Dec. 26, 1978, but modified to obtain a significantly higher degree of classification and separation of final product. This is particularly important in the fluidization of coal where the products resulting from ultrafine pulverization increases the burning rate of the coal to permit complete combustion, and also eliminates such impurities as ash, pyrites, aluminum oxide, silica, and the like. In this respect, it is especially desirable to eliminate pyrites because the major portion of the sulfur in raw coal is generally bound in these particles, whereas ash, which usually contains clays, kaolin, silica, etc. not only interferes with the combustion of the coal but also tends to deposit on the boiler tubes and causes slagging. The ultrafine grinding also permits the ash particles produced in the combustion to follow the flue gas streamlines in the tubes of such boilers, and permits the coal particles to be transmitted in pipe lines similarly to oil and gas.

Although jet-type grinding mills, such as that of the aforementioned U.S. Pat. No. 4,131,239 and others, have heretofore been used in an attempt to provide a satisfactory type of fluidized coal, they have never quite succeeded because of the difficulty of separating out particles that were small enough to pass out of the mill but large enough to prevent satisfactory performance of the product as a substitute for oil and gas.

It is, therefore, one object of the present invention to provide a jet-type mill and a process of using it which is capable of not only adequately grinding or pulverizing coal and similar materials to obtain ultrafine particles but is capable of separating out the ultrafine particles from those of large size.

Another object of the present invention is to provide a mill of the aforesaid type which is relatively simple in construction and easy to use and maintain.

Other objects and many of the attendant advantages of the present invention will be readily appreciated as the same becomes better understood by reference to the following description when read in conjunction with the accompanying drawings wherein.

Figure 1:
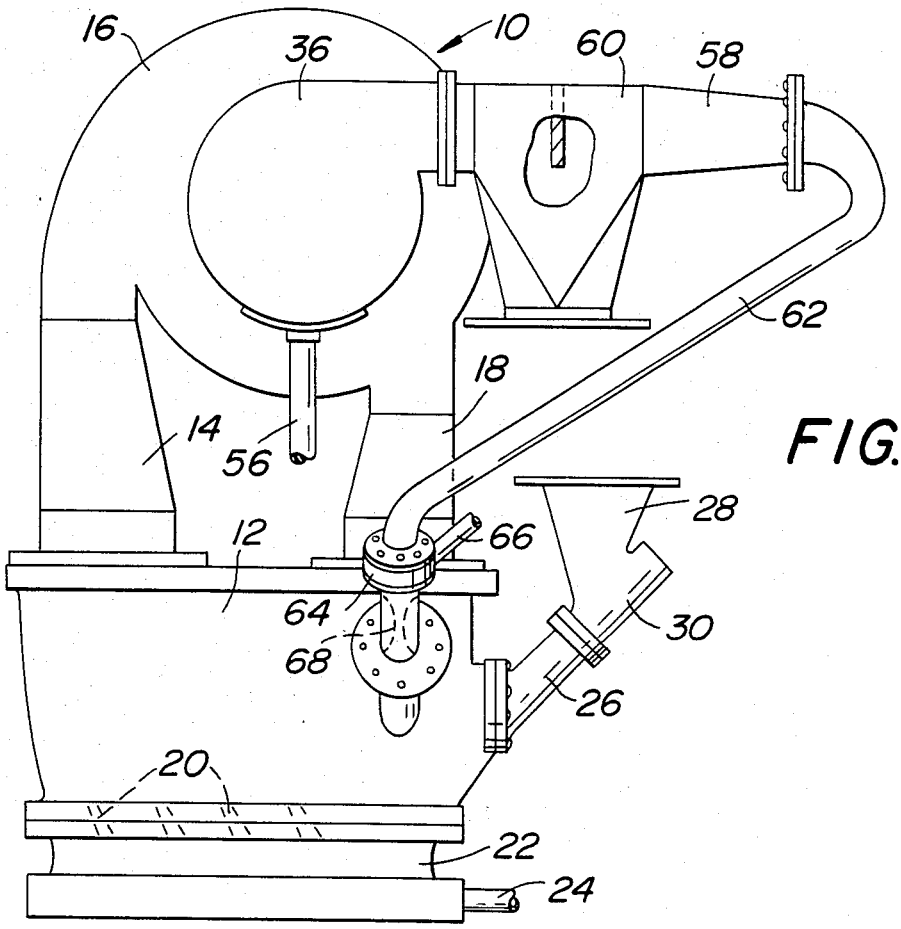
FIG. 1 is a side elevational view of a grinding mill and associated parts assembly embodying the present invention.
Figure 4:
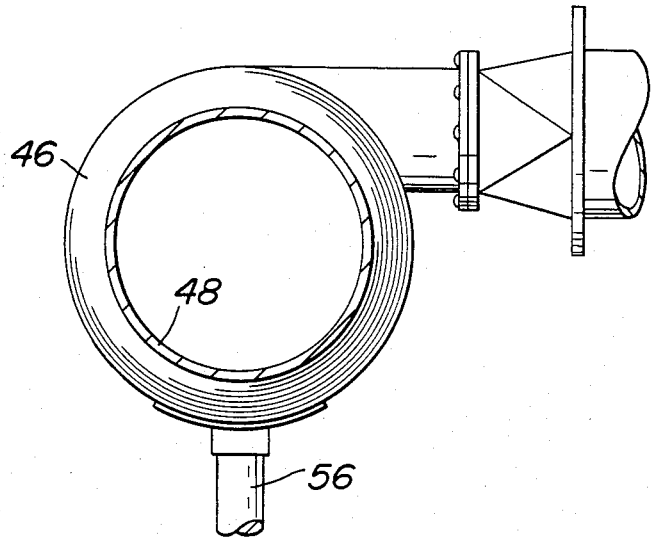
FIG. 4 is a sectional view taken on line 4—4 of FIG. 2, showing the tangential arrangement of the outlet.
Figure 2:
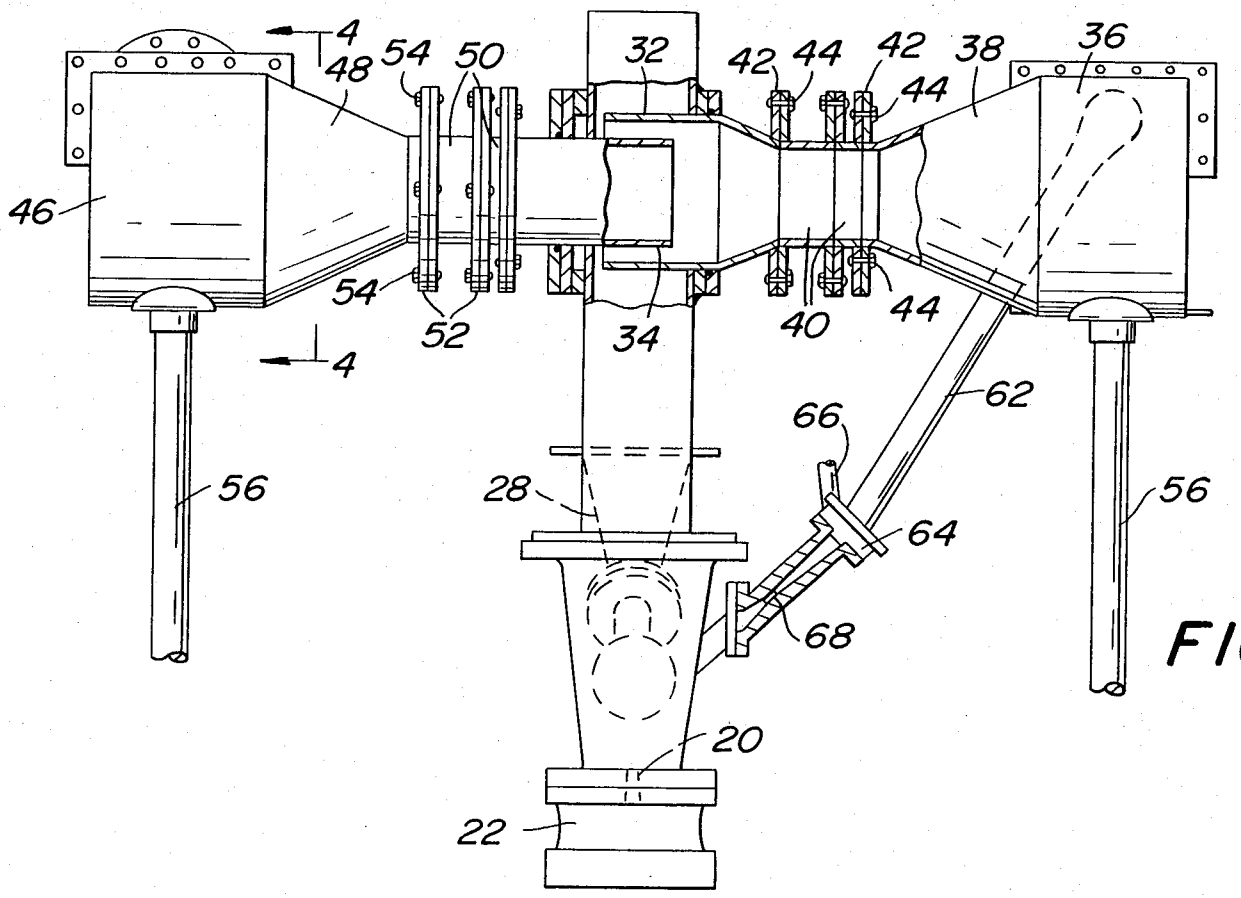
FIG. 2 is a front view, partly in elevation and partly in section, of the assembly of FIG. 1.
Figure 3:
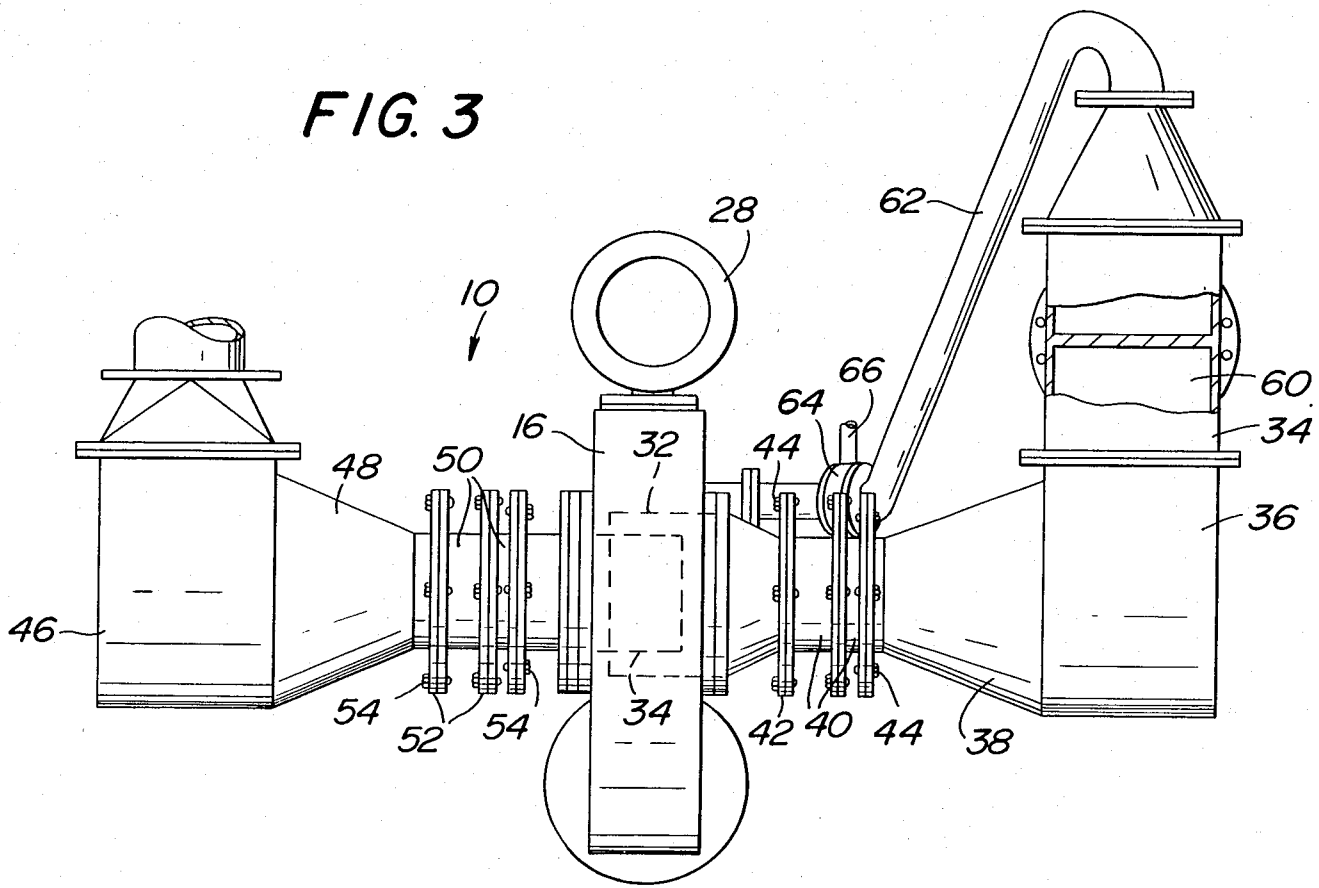
FIG. 3 is a top plan view of the assembly shown in FIGS. 1 and 2.

Referring in greater detail to the figures of the drawings wherein similar reference characters refer to similar parts, there is shown a grinding mill, generally designated 10, having an inlet or grinding chamber 12, an upstack 14, a classifier or separator section 16 and a downstack 18. Gaseous fluid nozzles 20 extend angularly from a gaseous fluid manifold 22 into the inlet chamber 12, the manifold 22 being connected to a source of gaseous fluid such as air, steam, or the like, under pressure (not shown), through a duct 24. A feed inlet 26 is provided at the lower portion of downstack 18 and is provided with a hopper 28 for injecting the particulate material to be ground into the mill. An offset duct 30 is provided beneath the hopper and this duct 30 is adapted to be connected to the source of gaseous fluid under pressure to accelerate the passage of the fed material into the mill.

The classifier section 16 is round in shape. This shape is used in order to make the internal gaseous fluid flow less turbulent and more laminar, thereby causing a greater separation of the heavier particles in the outer laminar stream from the lighter particles in the inner laminar stream. Within the classifier section 16 are situated a pair of coaxial tubular nozzles 32 and 34, the nozzle 34 being of the lesser diameter and fitting within the nozzle 32 in spaced relation thereto. The nozzle 32 is connected to a chamber 36 by means of a transition chamber 38 and a pair of tubular spacers 40, of varying sizes, connected by respective flanges 42 and bolts or the like shown at 44. The nozzle 34 is similarly connected to a chamber 46 through a transition chamber 48 and a pair of tubular spacers 50 connected by flanges 52 and bolts or the like shown at 54. The removable spacers 40 and 50 permit longitudinal adjustment of the nozzles 32 and 34 toward and away from each other in accordance with the number of spacers used. In this respect, although two such spacers, of varying sizes, are shown for each nozzle, the number and size of the spacers may vary as desired. It is also within the scope of this invention to substitute any other feasible and desirable longitudinal adjustment means. The entire assembly, including the nozzles 32 and 34 and their associated parts, is supported by posts 56 connected to the chambers 36 and 46, although other feasible support means may be substituted, if desired.

The nozzles 32 and 34 form an auxiliary cyclone type separator whereby the particles whirling through the mill arrange themselves by centrifugal force within the classifier section 16 so that the finer, lighter particles spiral inwardly as they are drawn toward the center by the viscous drag of the gaseous fluid, while the heavier particles are on the outer periphery. However, the outer periphery is circumscribed by the annular walls formed by the coaxial tubular nozzles 32 and 34 and the likelihood of any of the heavier particles escaping into the nozzle 34 is considerably reduced. The lighter, or ultrafine, particles therefore, pass through the nozzle 34 to the outlet chamber 46 from whence they are passed to a collection station or to any other station for further processing or distribution. The heavier particles pass around the outer periphery of the nozzles 34 between that nozzle and the inner surface of nozzle 32, and then travel to the chamber 36.

In addition to the main separation function provided by the nozzles 32 and 34 which form an auxiliary separator or classifier, some additional grinding takes place in the annular chamber formed between the two nozzles because of the whirling vortex effect. This increases the amount of ultrafine particles which flow into the mouth of the nozzle 34 as the heavier particles continue on their path toward the chamber 36.

The heavier particles which pass into the chamber 36 then pass into a duct 58 in which is interposed a separation chamber 60, which may be a centrifugal duct collector type, but which may also be of the quiescent baffle type or pressurized type. In the separation chamber 60, the heaviest particles, which are primarily undesirable ash, pyrites, aluminum oxide, silica, and the like, are removed from the stream while the remaining large particles, which are primarily coal, travel on through the duct 58 into a conduit 62. As they travel down through the conduit 62 they pass through an orifice plate 64 connected to a source of fluid pressure through a conduit 66. This orifice plate is provided with a plurality of annularly arranged nozzles (not shown) which project the gaseous pressure fluid through a Venturi passage 68 that acts to accelerate the flow of gas and particles back into the inlet chamber 12 for another pass through the mill.

Figure 5:
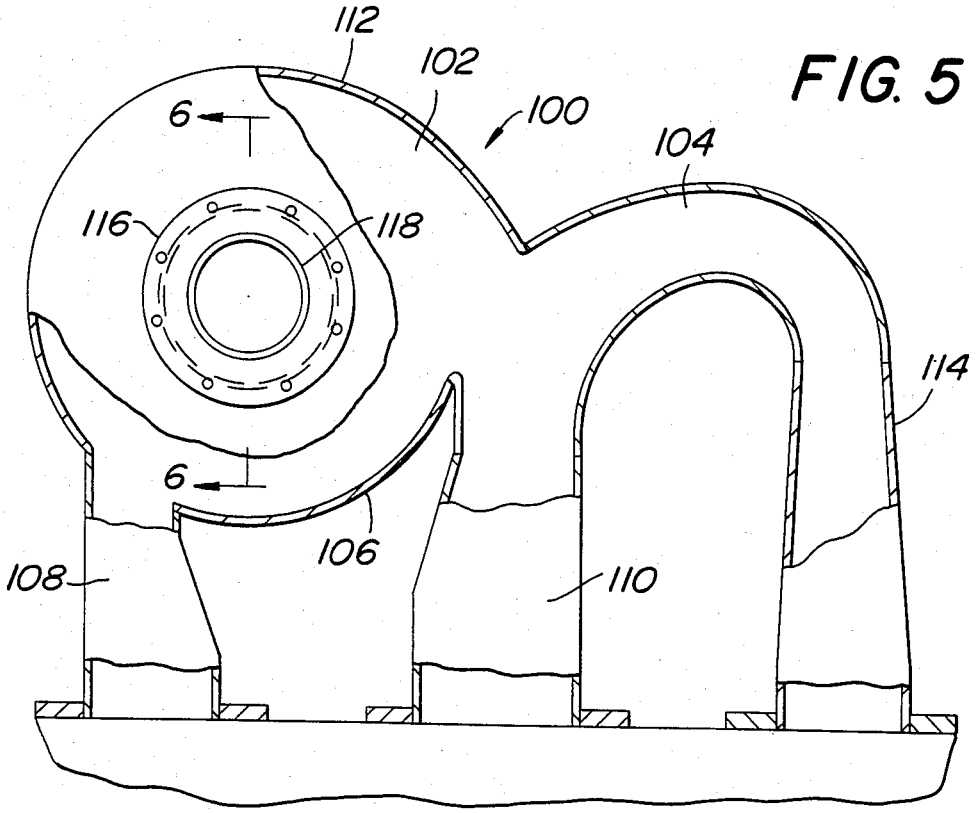
FIG. 5 is a fragmentary side view, partly in elevation and partly in section, of a modified mill assembly embodying the present invention.
Figure 6:
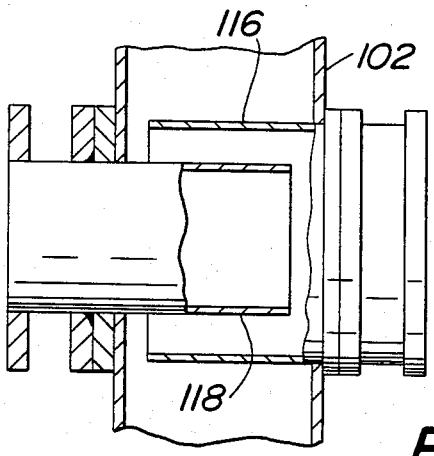
FIG. 6 is a sectional view taken on line 6—6 of FIG. 4.

FIGS. 5 and 6 illustrate the present invention as applied to a so-called double mill. Double mills are well-known in the art and comprise two downstacks in opposed relation with a common upstack section. Each mill section normally has a classifier section at its arcuate upper portion and an inlet chamber at the bottom, with angular or tangential nozzles provided to project gaseous fluid into the inlet chamber. This gaseous fluid entrains the particles and forms a vortex in which mutual pulverization takes place between the particles. Since the nozzles in one inlet chamber are at opposite angles to those in the other inlet chamber, the mixture of gas and particles passes upwardly through the common upstack and then, after classification, passes downwardly through the respective downstacks to the respective inlet chambers for further passes through the mill. This type mill is exemplified in U.S. Pat. No. 3,456,887, dated July 22, 1969 and in U.S. Pat. No. 3,467,317 dated Sept. 16, 1969.

In the mill, generally designated 100, which is partially shown in FIG. 5, the lower inlet or grinding chambers are not shown because they are essentially the same as the standard double mill described above. However, in the upper portion, a round classifier or separator section is situated in the section of the mill shown at the left hand side. This round classifier section is designated 102 and extends upwardly above the upper portion 104 of the section at the right hand side. A lower arcuate wall 106 of the classifier section 102, between the downstack 108 and the common upstack 110, coacts with the upper arcuate wall 112 to form the round contour of the classifier section.

Although some of the pulverized particles pass from the upstack through the upper portion of the right hand section of the mill and down through its downstack 114 to its inlet chamber, the bulk of the particles continue upwardly by centrifugal force beyond the right hand section to enter the round classifier section 102. Situated in this classifier section are an external tubular nozzle 116 and an internal tubular nozzle 118 in spaced relation to each other. These nozzles and their ancillary parts are similiar to the nozzles 32 and 34 and their ancillary parts as described above and shown in FIGS. 1, 2, 3, and 4, and will not be further described. These nozzles function in the same manner and for the same purpose as the nozzles 32 and 34.

The invention claimed is:

1. A jet-type grinding mill for relatively large particles wherein said particles are entrained in a gaseous vortex and caused to pulverize each other during their passage through a grinding chamber in the mill, a classifier section upstream of the grinding chamber, and an outlet from the classifier section, lighter ground particles being separated from heavier ground particles in the classification section by centrifugal force, and the lighter particles passing through said outlet by the action of said centrifugal force, a pair of opposed coaxial tubular nozzles within said classifier section, one of said nozzles having a relatively smaller diameter than the other and being arranged within said other in radially spaced relation thereto, the nozzle of relatively smaller diameter being operatively connected to said outlet and said other nozzle being operatively connected to said grinding chamber, said nozzles forming a secondary centrifugal separator within the classification section, whereby the finer particles are drawn into the smaller nozzle while the heavier particles are maintained separate therefrom in the annular chamber formed between the two nozzles.

2. The system of claim 1 wherein said nozzles are axially adjustable relative to each other.

3. The system of claim 1 wherein an auxiliary separator is operatively positioned between the inlet end of said other nozzle and the grinding chamber.

4. The system of claim 1 wherein said other nozzle is operatively connected to said grinding chamber by a conduit, said conduit having means to accelerate the flow of particles from said other nozzle into said grinding chamber.

5. The system of claim 1 wherein said mill is generally arcuate and comprises an upstack on one side leading from said grinding chamber to said classifier section and a downstack leading from said classifier section to said grinding chamber.

6. The system of claim 5 wherein said classifier section is substantially round.

7. The system of claim 1 wherein said mill comprises a pair of generally arcuate portions formed by oppositely arranged downstacks leading into a common grinding chamber and a common upstack leading from said common grinding chamber to said classifier section.

8. The system of claim 7 wherein said classifier section is substantially round.

9. A method of grinding relatively heavy particles which comprises entraining said particles in a whirling vortex of gaseous fluid to cause said particles to pulverize each other under the action of said gaseous fluid in said vortex, initially separating the smaller particles resulting from the pulverization from the larger particles resulting from the pulverization by means of centrifugal force causing stratification of the smaller particles on the inner periphery of a circulating stream and of the larger particles on the outer periphery thereof in a classifier area and then causing a secondary separation of smallest from less small particles in said classifier area by subjecting said smaller particles to a secondary centrifugal separation at the center of said circulating stream while simultaneously subjecting said less small particles to a further pulverization action at the outer periphery of said circulating stream surrounding said center.

10. The method of claim 9 wherein the relatively heavy particles are coal.

* * * * *